United States Patent [19]

Helms

[11] Patent Number: 4,729,432

[45] Date of Patent: Mar. 8, 1988

[54] ACTIVATION MECHANISM FOR DIFFERENTIAL FILL FLOATING EQUIPMENT

[75] Inventor: Lonnie C. Helms, Ducan, Okla.

[73] Assignee: Halliburton Company, Duncan, Okla.

[21] Appl. No.: 44,878

[22] Filed: Apr. 29, 1987

[51] Int. Cl.[4] ..... E21B 34/14

[52] U.S. Cl. ..... 166/317; 166/318; 166/327; 166/332

[58] Field of Search ..... 166/318, 317, 325, 327, 166/332, 154, 156, 323

[56] References Cited

U.S. PATENT DOCUMENTS

| | | | |
|---|---|---|---|
| 3,054,415 | 9/1962 | Baker et al. | 166/318 X |
| 3,481,397 | 12/1969 | Baker . | |
| 3,566,962 | 3/1971 | Pease, Jr. et al. | 166/202 X |
| 4,099,451 | 7/1978 | Blackwell | 166/202 X |
| 4,220,206 | 9/1980 | Van Winkle | 166/317 X |
| 4,355,686 | 10/1982 | Arendt et al. | 166/318 X |
| 4,474,241 | 10/1984 | Freeman | 166/317 |
| 4,566,541 | 1/1986 | Mouny et al. | 166/318 |

OTHER PUBLICATIONS

Halliburton Services Sales and Service Catalog, No. 41, p. 3852.

*Primary Examiner*—James A. Leppink
*Assistant Examiner*—Hoang C. Dang
*Attorney, Agent, or Firm*—James R. Duzan; Joseph A. Walkowski

[57] ABSTRACT

A differential fill valve assembly for application in float collars or shoes in well casing. The valve assembly comprises a back pressure flapper valve disposed within a substantially tubular upper housing, and a lower housing containing an activating sleeve slidably disposed therein above a double flapper valve assembly. The activating sleeve initially extends into the upper housing to a sufficient extent to maintain the flapper valve in an open position and comprises a lower tubular sleeve surmounted by a circumferential ring of longitudinally upwardly extending collet fingers having radially inwardly extending shoulders thereon, said fingers and shoulders having elastomeric inserts extending therebetween; the activating sleeve is maintained in this position through use of shear pins, by which it is secured to a support ring associated with the lower housing. The double flapper valve comprises a first flapper responsive to pressure below the valve assembly, and a second flapper responsive to force applied from above. A tripping ball is dropped to seat on the shoulders in the activating sleeve when it is desired to release the back pressure flapper valve; pressure applied on the ball moves the activating sleeve downward, releasing the back pressure flapper valve and swinging the double flapper valve assembly out of the flow path through the differential fill assembly, after which the tripping ball exits the bottom of the assembly. Outward deformation of the collet ring maintains the activating sleeve in its lower position.

9 Claims, 3 Drawing Figures

ACTIVATION MECHANISM FOR DIFFERENTIAL FILL FLOATING EQUIPMENT

BACKGROUND OF THE INVENTION

This invention relates to the field of floating equipment for well bore casing. When casing is being run into the well bore, particularly where deep wells are concerned, it is desirable to "float" the casing down to its intended location on the well bore fluid so as to relieve some of the strain from the derrick, prior to the time the casing is cemented in the well. It is also desirable to have the casing fill automatically at a predetermined rate, so as to save rig time.

To accomplish these desired results, "differential fill" float shoes and float collars have been developed, which devices permit automatic filling of the casing and also incorporate a back pressure valve to prevent cement back flow into the casing after the cementing operation. Such a back pressure valve also permits the option of terminating the filling of the casing at any point in time. One example of the prior art is the Halliburton Services Differential Fill Float Collar and Differential Fill Float Shoe, described and illustrated on page 3852 of Halliburton Services Sales and Service Catalog Number 41. The collar and shoe employ the same valve assembly, which comprises a back pressure flapper valve at the top of the assembly, and a double flapper valve at the bottom of the assembly, the larger valve being a circulating flapper valve with a "piggyback" fillup flapper valve on it. During the insertion of casing into the well bore, the back pressure flapper valve is held open by a pin set across the valve assembly bore. As the casing enters the well bore, the preset spring tension of the fillup flapper valve spring allows controlled filling of the casing to a predetermined differential pressure between the casing interior and the well bore annulus. Fluid may be circulated through the casing at any time due to the presence of the circulating flapper valve. When it is desired to actuate the back pressure valve to prevent further filling of the casing as it is being run in, or after circulation has been established prior to initiating of the cementing operation for the casing, a weighted tripping ball is dropped, which breaks the pin holding open the back pressure flapper. After cementing has been completed, the released back pressure flapper prevents cement flow back into the casing from the well bore annulus. The above described valve assembly suffers from several noteworthy disadvantages. First, there is a tendency of the pin to release the back pressure flapper prematurely, before the tripping ball is dropped. Additionally, the ball's relatively unimpeded travel through the valve assembly resulted in the ball failing to strike the pin squarely or even missing it entirely, and passing downward without releasing the back pressure flapper.

Another prior art differential fill float shoe is disclosed in U.S. Pat. No. 3,481,397 to Baker, assigned to Halliburton Company, and incorporated herein by reference. This design also possesses a back pressure flapper valve at the top of the shoe assembly with a double "piggyback" valve as described previously at the bottom. The back pressure flapper valve is maintained in an open position by a short tube, slidably disposed in the shoe bore between the back pressure valve and the double valve. The tube is maintained in place by a shear pin, and possesses a deformable lip at the bottom. When the operator wishes to release the back pressure valve, a tripping ball is pumped down the casing bore to the lip in the tube, at which point the fluid pressure above the ball first shears the tube shear pin and moves the tube downward, releasing the back pressure valve. After the tube has reached the full extent of its downward travel, the lip suddenly deforms, releasing the ball to continue downward and out of the shoe assembly. The tube is maintained in its lower position by springs which snap over the top of the tube as it passes in a downward direction. While an improvement over the above-referenced design, this device does not provide a full-open bore for the passage of cement in a downward direction, as the double valve is to be held open strictly by the downward flow of cement. This poses problems due to jamming of the double valve by debris in the casing bore, and also reduces the immediate sealing pressure applied to the back pressure valve when the downward flow of cement under pump pressure ceases. Furthermore, the means for maintaining the tube in its lower position are deficient in that they are exposed to the highly abrasive cement flow, with the attendant possibility of failure and jamming of the back pressure valve in an open position when cement pumping ceases and a reverse flow of cement commences. Finally, the ball is subjected to such a great fluid pressure buildup above it when it contacts the lip in the tube, that the sudden deformation and downward release of the ball causes it to be "shot" at the double valve and break off the fillup flapper from the circulating flapper, or the latter from the shoe assembly.

Other differential fill floating equipment designs are known which employ a sliding piston which holds the hydrostatic pressure in the casing to a percentage of the total depth of the casing run. Such a design allows only one pressure, which on occasion causes excess floating of larger diameter casing.

Finally, U.S. Pat. No. 4,474,241 to Freeman, assigned to Halliburton Company discloses a differential fill valve assembly which provides a means for positive retention of a back pressure valve in an open mode during run-in of the casing, a fillup flapper valve mounted piggyback on a circulating flapper valve, and means to open the circulating flapper valve and maintain it in an open mode. The Freeman differential fill valve assembly comprises a back pressure flapper valve disposed within a substantially tubular upper housing, and a lower housing containing a slidably disposed activating sleeve therein above a double flapper valve having a fillup flapper valve mounted piggyback on a larger, circulating flapper valve which is attached to the lower housing.

As casing is run into the well bore, the valve assembly is located in a float collar or float shoe, or both, in the casing. The activating sleeve holds the back pressure flapper in an open mode, and is itself maintained in position through use of shear pins, by which it is secured to the lower housing. Circulation may be established at any time through the circulation flapper valve after the casing is run, but as the casing is lowered in the well bore the fillup flapper permits controlled filling of the casing to a predetermined differential pressure variable by varying the spring tension thereon. When desired, the back pressure valve can be activated by dropping a weighted tripping ball, which will contact a seat in the bore of the activating sleeve, causing a pressure buildup above the ball which will shear the pins holding the activating sleeve and permit its downward movement inside the lower housing. The nose of the activating sleeve will cause the double flapper valve assembly to swing downward and out of the way of the housing bore, maintaining the double flapper valve assembly in the open position after the tripping ball has extruded past the ball seat and out of the bottom of the tool. As the activating sleeve moves downward, the back pressure valve is released. Rotation of the activating sleeve in the lower housing is prevented initially by the shear pins, then by the slidable retention of a shear screw head in a longitudinal groove cut in the lower housing, and finally by contact with the double flapper valve assembly. A lock ring maintains the activating sleeve in its lower position after the tripping ball is extruded through the tool.

The Freeman device, while an advance in the art, suffers some disadvantages. Most notable is the requirement that the tripping ball be transported to the seat at relatively low fluid flow rates; otherwise the ball passes through the activating sleeve by deforming the lip without first moving the sleeve. Thus, the operator cannot establish a high rate of circulation through the valve assembly without taking a chance that it may fail to operate properly. In addition, the use of a lock ring to prevent the activating sleeve from moving upward after tripping results in a more complex and expensive valve assembly.

SUMMARY OF THE INVENTION

In contrast to the prior art, the differential fill valve assembly, while otherwise similar to that of Freeman, employs an activating sleeve having a ring of collet fingers at the upper end thereof, each finger having an inwardly extending shoulder on the interior thereof which together form a seat to catch the tripping ball. Fluid leakage through the collet ring is prevented by use of an elastomer molded between the fingers and shoulders. The collet finger/elastomer seat catches the tripping ball, and inhibits the latter's movement therethrough until shear pins holding the activating sleeve have parted. Initially, outward expansion of the collet ring and shoulders is precluded by a surrounding support ring in which the outer ends of the shear pins are secured. After the top of the activating sleeve passes through the support ring and has reached the full extent of its permitted downward travel, fluid pressure above the tripping ball causes it to deform the now radially unsupported collet ring outwardly permitting the ball to pass and preventing subsequent upward movement of the sleeve.

BRIEF DESCRIPTION OF THE DRAWINGS

The differential fill valve assembly of the present invention will be better understood by reference to the following detailed description of its construction and operation, taken in conjunction with the appended drawings, wherein.

DETAILED DESCRIPTION AND OPERATION OF THE PREFERRED EMBODIMENT

Figure 1:
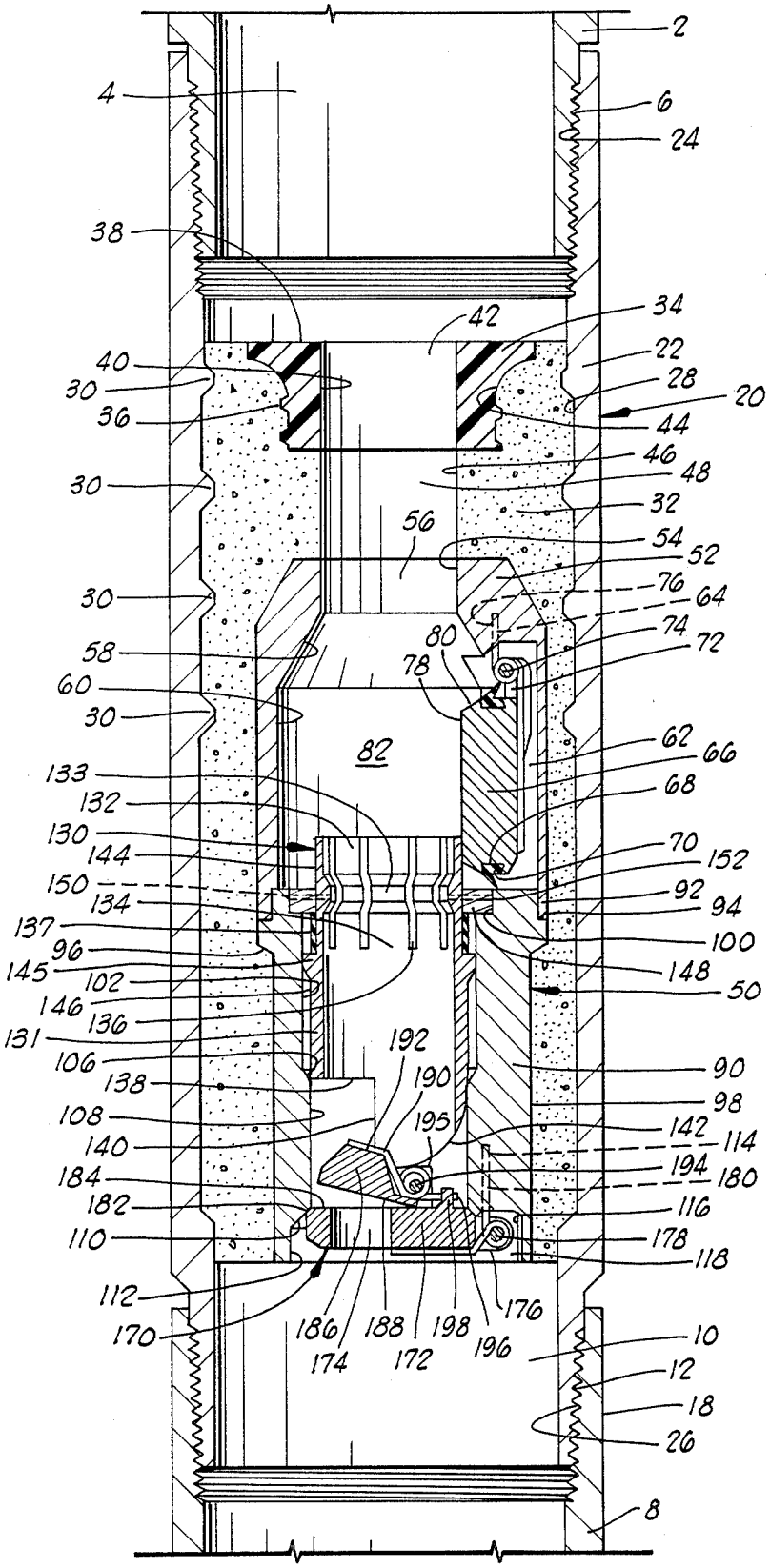
FIG. 1 is a vertical full sectional elevation of the differential fill valve assembly of the present invention, employed in a casing float collar, in its initial state as run into the well bore.

Referring to FIG. 1 of the drawings, the differential fill valve assembly of the present invention is described hereafter. Float collar 20 is suspended in a well bore from upper casing 2, having bore 4. Collar 20 comprises generally cylindrical steel tubing 22, which possesses threads 24 at its upper end which mate with threads 6 on casing 2. Tubing 22 is attached at its lower end to lower casing 18, having bore 10, by threads 26 which mate with threads 12 on lower casing 8.

Tubing 22 has a substantially uniform inner diameter 28, from which a plurality of annular shoulders 30 extend inwardly to hold cement casting 32 in place. At the top of casting 32, plastic plug seat insert 34 is maintained in place by exterior threads 36, which securely fix it in casting 32 along contact surface 44. Plug insert 34 has a flat top surface 38 and substantially uniform axial bore wall 40 defining insert bore 42. Bore wall 42 is contiguous with bore wall 46 in casting 32, defining casting bore 48, of substantially the same diameter as insert bore 42.

Below casting bore 48, differential fill valve assemly 50 is securely maintained in place by cement casting 32. Valve assembly 50 comprises substantially tubular upper housing 52, having entry bore wall 54 defining axial entry bore 56. Below entry bore 56, frustoconical bore wall 58 extends radially out-ward in a downward direction to cylindrical bore wall 60. One side of bore wall 60 is cut out to provide flapper valve recess 62. At the upper extent of flapper recess 62, spring end recess 64 is shown in broken lines. Back pressure flapper 66 is disposed in flapper recess 62, flapper 66 having annular recess 68 in its circumference, within which is disposed annular elastomeric seal 70, having a flexible lip at the outer extent thereof. Flapper 66 is pivoted on pin 74 by flapper arm 72, and is biased toward a closed position by flapper spring 76 acting thereupon. The undersurface 78 of flapper 66 is generally flat. An outwardly flaring frustoconical surface 80 extends from undercut surface to elastomeric seal 70. The bore area defined by bore wall 60 and flapper recess 62 is generally referred to as flapper chamber 82. Lower housing 90 possesses an upper exterior surface 92, terminating at outwardly radially extending annular shoulder 94, which leads to a somewhat larger exterior diameter, continuing a short distance to frustoconical surface 96, leading to substantially uniform outer surface 98, which extends to the bottom of lower housing 90.

The interior of lower housing 90 possesses annular recess 100 opening onto bore wall 102, which extends below recess 100 to frustoconical surface 106 leading to reduced diameter bore wall 108. At the lower extent of bore wall 108, frustoconical surface 110 flares downwardly and outwardly to bore wall 112. Lower housing 90 also has a longitudinally extending spring hole 114, (shown in broken lines), which opens onto pin recess 118 defined by milled out surface 116.

Activating sleeve 130 is slidably contained within lower housing 90, and comprises tubular lower sleeve 131 surmounted by a circumferential ring of longitudonally upwardly extending collet fingers 132, both defining activating sleeve bore 134. Inwardly radially directed shoulders 133 extend from the inner surface of collet fingers 132 into activating sleeve bore 134 a short distance. Elastomeric inserts 136 extend between and are bonded to adjacent collet fingers 132 and shoulders 133, inserts 135 being connected in the preferred embodiment by sleeve 137 of the same material and surrounding said activating sleeve means. At the lower end of activating sleeve 130, laterally extending circumferential undercut edge 138 leads to longitudinally downward extending edges 140, from which substantially equal length arcuate circumferential edges 142 extend upwardly to meet at their uppermost extents.

The exterior of activating sleeve 130 is defined by exterior surface 144, below which annular shoulder 145 having a radially flat upper face and a frustoconical lower face protrudes outwardly and then tapers inwardly to exterior surface 146, of slightly smaller diameter than bore wall 108.

Activating sleeve 130 is initially secured to lower housing 90 by a plurality of diametrically opposed shear pins 150 which extend from support ring 148 in annular recess 100 into apertures in annular shoulders 133. Support ring 150 is secured in recess 100 by an interference fit at 152, although welding, bonding or other securing means are equally applicable.

Double flapper valve 170 at the lower end of lower housing 90, comprises circulating flapper 172 having aperture 174 therethrough, and flapper arm 176 from which circulating flapper is suspended from lower housing 90 by pin 178. Circulating flapper 172 is biased toward a closed position by spring 180, the end of which rests in spring hole 114 opening into pin recess 118. Flat upper surface 184 of circulating flapper 172 is bounded by frustoconical surface 182, which is inclined at the same angle as surface 110 in lower housing 90, which latter surface acts as a valve seat for surface 182 of circulating flapper 170.

Fillup flapper 186, riding on circulating flapper 172, possesses flat lower surface 188 adjacent flat upper surface 184 of circulating flapper 172. Spring 190 acts on the top 192 of fillup flapper 186, which is secured to circulating flapper 172 through pin 194 which extends at each of its ends into apertures in pin mounts 195 on circulating flapper 172. A loop 196 in the middle of spring 190 extends over spring catch 198 to insure proper spring positioning and biasing of fillup flapper 186 to a completely closed position.

Figure 2:
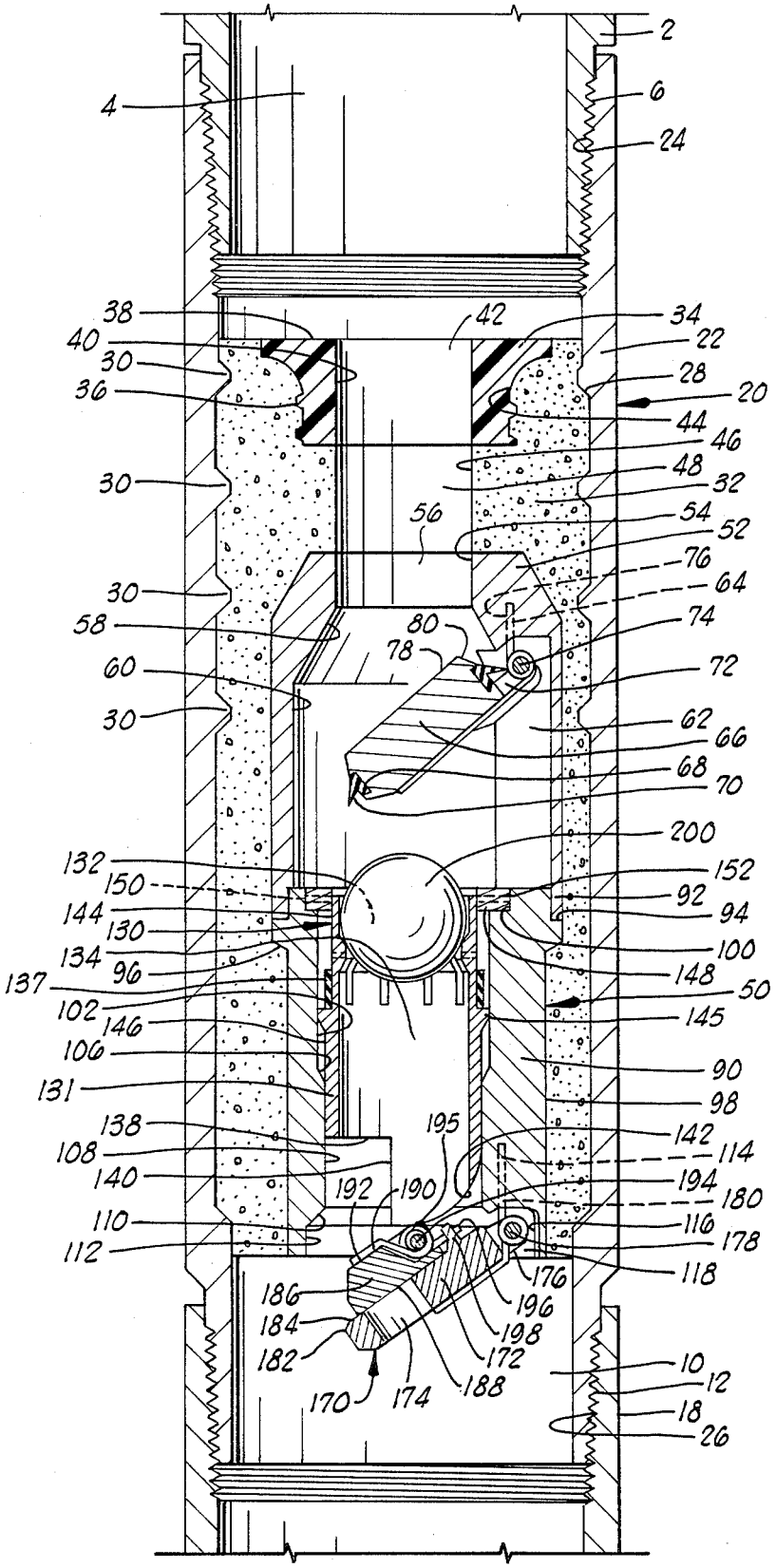
FIG. 2 is a view similar to FIG. 1, showing the position of the activating sleeve after the tripping ball has been dropped and seated on the ball seat, and the activating sleeve has contacted the double flapper valve and begun to open it.
Figure 3:
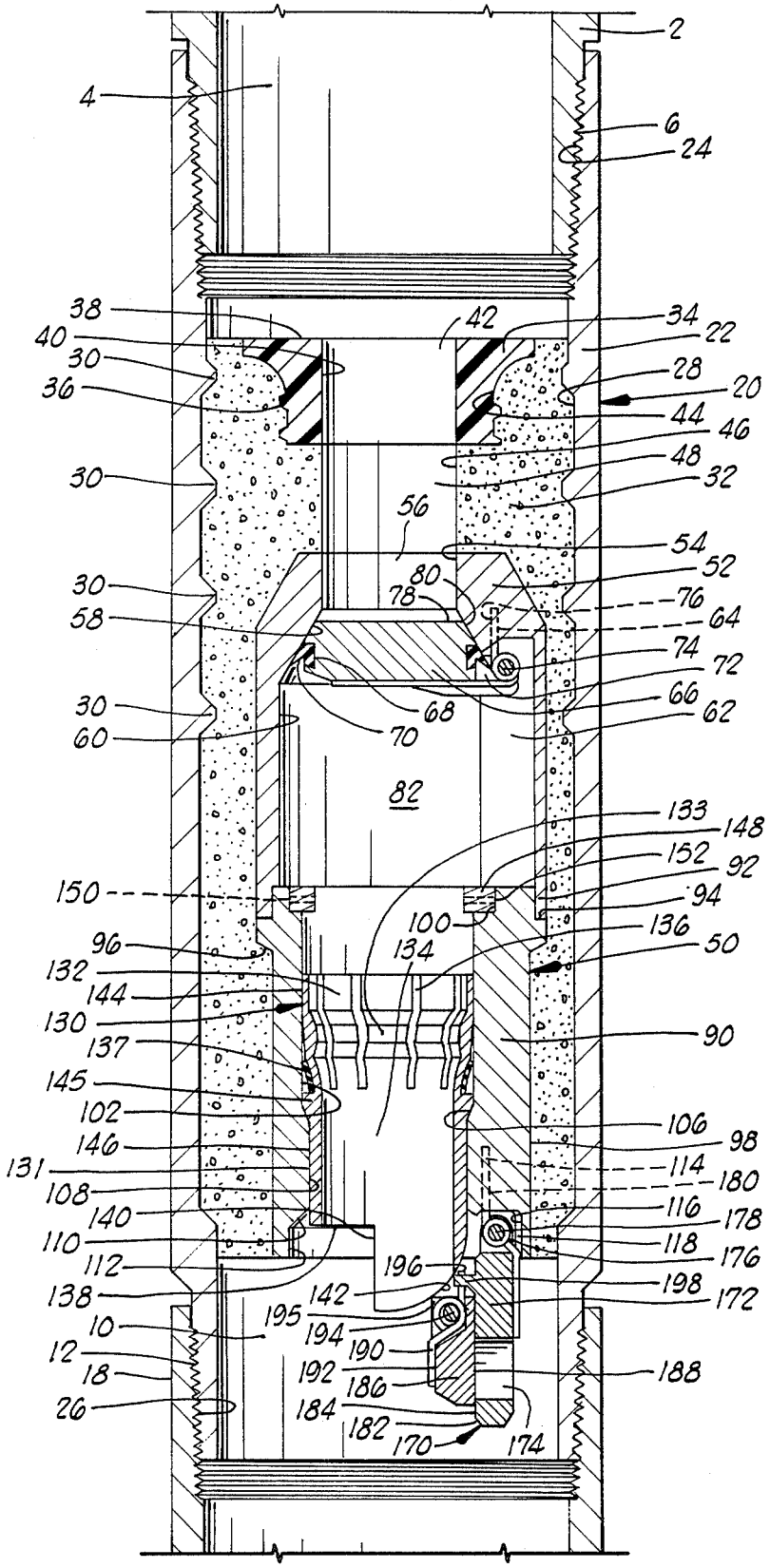
FIG. 3 is a view similar to FIG. 1, showing the position of the activating sleeve after the tripping ball has outwardly deformed the activating sleeve and the ball seat and exited the bottom of the collar.

Referring now to drawing FIGS. 1, 2 and 3, the operation of the preferred embodiment of the invention is described hereafter.

Differential fill float collar 20, as previously noted, is run into the open well bore suspended from casing 2. The well bore is generally filled with fluid such as drilling mud, and the casing is "floated" into the well bore. As shown in FIG. 1, as the casing is lowered in the well bore, the hydrostatic pressure in casing bore 10 below differential fill float collar 20 overcomes the biasing action of spring 190 which tends to close fillup flapper 186. Fillup flapper 186 is permitted to open freely due to the configuration of the bottom of activating sleeve 130, wherein undercut edge 130 and longitudinally extending edges 140 define an open area to permit rotational opening of fillup flapper 186. The casing bore 4 above differential fill float collar 20 is then filled with well bore fluid at a gradual rate, so that the casing 2 above float collar 20 is only partially filled and "floated" into the hole, lessening strain on the derrick. Casing bore 4 will fill at a rate proportional to the differential hydrostatic pressure across the fillup flapper 186. If the running of casing is stopped, fillup flapper 186 will close whenever the hydrostatic pressure in casing bore 4 plus the spring force of spring 190, both acting on fillup flapper 186, is equal to the hydrostatic pressure below float collar 20 in casing bore 10. The fluid level above float collar 20 will thus be below that outside the casing. The difference in fluid level is a function of the weight of the drilling fluid and the fillup spring size; the fillup spring may be easily selected to provide the desired fill rate.

While the casing is being run, the top end of activating sleeve 130 maintains back pressure flapper 66 in an open position. Circulation can be established at any time during the running of the casing without releasing activating sleeve 130, simply by pumping down the casing, the fluid pressure thus generated forcing open valve assembly 170 against the biasing force of spring 180.

At any point during the running of the casing or after all casing has been run, back pressure flapper 66 may be released and valve assembly 170 inactivated. Referring to FIGS. 2 and 3, weighted tripping ball 200 is dropped down the casing bore 4, where it travels downward until it seats on shoulders 133 of collet fingers 132 at the top of activating sleeve 130. The pressure above ball 200 will build due to the presence of elastomeric inserts 136 between collet fingers 132 and shoulders 133, until shear pins 150 shears (FIG. 2), and activating sleeve 130 travels downward releasing back pressure flapper 66. Outward expansion of collet fingers 132 is prevented by support ring 148. Activating sleeve 130 is also prevented from rotating prior to the dropping of tripping ball 200 by shear screws 150. As pressure above ball 200 is maintained, activating sleeve 130 travels downward further in lower housing 90, and arcuate edges 142 of activating sleeve 130 contact valve assembly 170 and move it downward and rotationally outward against the biasing action of spring 180, until valve assembly 170 is substantially longitudinally oriented with respect to float collar 20 (FIG. 3). The presence of arcuate edges 142 on activating sleeve 130 prevents jamming of the activating sleeve 130 and valve assemly 170 when the former contacts the latter, such as a flat bottom edge on activating sleeve 130 might facilitate. As activating sleeve 130 reaches the full extent of its travel, and the upper extent thereof is no longer radially supported by support ring 150, ball 200 plastically deforms shoulders 133 and collet fingers 132 radially outwardly and is pumped out of float collar 20 to the bottom of the well bore. Activating sleeve 130 is prevented from moving back to its original position by the outward deformation of the collect fingers 132 against bore wall 102, which provides frictional engagement therebetween, as well as by the fact that the deformed collet ring is of greater diameter than that of the bore of support ring 150, and cannot pass upwardly therethrough.

As the cementing operation is performed, released back pressure flapper 66 is able to control any back flow of cement up into casing bore 4, as elastomeric seal 70 seats on annular surface 58 on upper housing 52 as the hydrostatic pressure in casing bore 10 and the force of spring 76 urges back pressure flapper 66 into a closed position. At the resumption of cement pumping, pump pressure in casing bore 4 overcomes the spring force and hydrostatic pressure below float collar 20, and back pressure flapper reopens.

After the cementing operation is completed, the interior components of float collar 20 are drilled out by means known in the art to provide an open casing bore to the bottom of the casing.

Thus it is apparent that a new and improved differential fill valve assembly has been invented. Of course, it will be apparent to one of ordinary skill in the art that additions, deletions and modifications may be made to the invention as shown and described in the preferred embodiment, without departing from the spirit and scope of the invention as claimed.

I claim:

1. A differential fill valve assembly, comprising:

substantially tubular body means having upper and lower longitudinal bores therin;

back pressure flapper means secured to said body means, adapted to seat across said upper bore and including first spring biasing means;

double flapper valve assembly means having a larger and a smaller flapper, said larger flapper having an aperture therethrough, being secrued to said body means and adapted to seat across said lower bore, said smaller flapper being secured to said larger flapper and adapted to seat thereon over said aperture, and said larger flapper and said smaller flapper including second and third biasing means, respectively; and substantially tubular activiating sleeve means slidably disposed in said lower bore between said back pressure flapper means and said double flapper valve assembly means, said activating sleeve means having a top and bottom and comprising a lower tubular sleeve surmounted by a circumferential ring of upwardly extending collet fingers having inwardly radially directed shoulders extending from their inner surfaces and including elastomeric insert means extending between adjacent collet fingers and shoulders, said annular shoulders and insert means defining a ball seat means, said top protruding above said lower bore and maintaining said back pressure flapper means in an open mode in a first longitudinal position, and releasing said back pressure flapper means in a second longitudinal position spaced position wherein said bottom protrudes below said lower bore and rotates said larger flapper to an open mode against said second biasing means.

2. The apparatus of claim 1, further including:

support ring means secured to said tubular body means in, proximate the top of, and surrounding said lower bore; and shear pin means extending from said support ring means into said collet fingers when said activating sleeve means is in said first longitudinal position.

3. The apparatus of claim 2, wherein said insert means are interconnected by elastomeric sleeve means surrounding said activating sleeve means.

4. The apparatus of claim 3, wherein said collet fingers are adapted to outwardly deform against the wall of said lower bore when the top of said activating sleeve moves below said support ring means.

5. The apparatus of claim 4, wherein the inner diameter of said support ring means is less than the diameter of said lower bore therebelow.

6. A sleeve-shifting apparatus for use in a downhole tool having a bore in which said sleeve is slidably disposed, comprising;

an activating sleeve comprising a lower tubular portion surmounted by a circumferential ring of longitudinally upwardly extending collet fingers;

inwardly radially extending shoulders on said collet fingers;

elastomeric insert means extending shoulders on said collet fingers;

elastomeric insert means extending between adjacent collet fingers and shoulders;

support ring means secured to said tool proximate the top of, and surrounding, said tool bore; and shear pin means extending from said support ring means into said collet fingers proximate said shoulders.

7. The apparaturs of claim 6, wherein said insert means are interconnected by elastomeric sleeve means surrounding said activating sleeve.

8. The apparatus of claim 7, wherein said collet fingers are adapted to outwardly deform against the wall of said tool bore when said activating sleeve is moved below said support ring means.

9. The apparatus of claim 8, wherein the inner diameter of said support ring means is less than the diameter of said tool bore therebelow.

* * * * *